US005136650A

United States Patent [19]

Griesinger

[11] Patent Number: 5,136,650

[45] Date of Patent: Aug. 4, 1992

[54] SOUND REPRODUCTION

[75] Inventor: David H. Griesinger, Cambridge, Mass.

[73] Assignee: Lexicon, Inc., Waltham, Mass.

[21] Appl. No.: 639,043

[22] Filed: Jan. 9, 1991

[51] Int. Cl.[5] ..... H04S 3/00

[52] U.S. Cl. ..... 381/22; 381/1; 381/24

[58] Field of Search ..... 381/1, 22, 24

[56] References Cited

U.S. PATENT DOCUMENTS

| | | |
|---|---|---|
| 3,772,479 | 11/1973 | Hilbert . |
| 3,786,193 | 1/1974 | Tsurushima . |
| 3,798,373 | 3/1974 | Bauer . |
| 3,812,295 | 5/1974 | Bauer . |
| 3,825,684 | 7/1974 | Ite . |
| 3,829,615 | 8/1974 | Hiramatsu . |
| 3,836,715 | 9/1974 | Ite . |
| 3,934,086 | 1/1976 | Takahashi . |
| 3,944,735 | 3/1976 | Willcocks . |
| 3,959,590 | 5/1976 | Scheiber . |
| 4,027,101 | 5/1977 | DeFreitas . |
| 4,074,083 | 2/1978 | Berkovitz . |
| 4,236,039 | 11/1980 | Cooper . |
| 4,704,728 | 11/1987 | Scheiber . |
| 4,862,502 | 8/1989 | Griesinger . |
| 4,891,839 | 1/1990 | Scheiber ..... 381/22 |

FOREIGN PATENT DOCUMENTS 1112233 5/1968 Fed. Rep. of Germany .

OTHER PUBLICATIONS

Julstrom, "A High Performance Surround Sound Process for Home Video", J. Audio Eng. Soc., vol. 35, No. 7/8, 1987, pp. 536–549.

*Primary Examiner*—Forester W. Isen
*Assistant Examiner*—Nina Tong
*Attorney, Agent, or Firm*—Fish & Richardson

[57] ABSTRACT

A sound reproduction system for converting encoded stereo signals on input channels A and B into signals on left, supplemental left, right, and supplemental right output channels, respectively, that includes a left output channel for producing output signals intended to come from the left direction; a supplemental left output channel for producing output signals similar in level (intensity) to output signals of the left output channel and with reduced steered signal level for left direction signals; a right output channel for producing output signals intended to come from the right direction; and a supplemental right output channel for producing output signals similar in level (intensity) to output signals on the right output channel and with reduced steered signal level for right direction signals.

15 Claims, 2 Drawing Sheets

SOUND REPRODUCTION

SOUND REPRODUCTION

This invention relates to sound reproduction systems, and more particularly to systems for converting two channel input signals to multiple channel output signals.

Most films made at present utilize a two channel distribution system for sound. This system consists of an encoder used when the film is mixed, which takes four inputs, Left, Center, Right and Surround (or rear), and with a passive matrix mixes these four inputs into two output channels. The two channel mix thus derived is played back through a decoder which attempts to recreate the original four channels from the incoming two.

Both during the mixing, and later when the film is screened, the speaker arrangement is carefully standardized. The center channel loudspeaker is always located behind the center of the screen, so the majority of dialog will appear to come from the center of the screen regardless of where a listener is located in the theater. The left and right main speakers are also located behind the screen, but at the left and right edges. The apparent location of sound effects, and sometimes dialog, is panned between the left, center and right of the screen by controlling the relative level of sound in those three speakers. For any particular direction only one or at most two speakers are used. One of the main jobs of a decoder used with this system is to prevent leakage of sound which should only come from one or two of these loudspeakers into the others. Such leakage destroys the directional illusion for listeners who are not in the center of the theater.

The fourth, or Surround, channel is fed in parallel to an array of loudspeakers which surrounds the whole audience, both at the rear and the sides of the theater. Since these speakers are all wired together it is not possible to make a sound effect which comes from a particular side or rear direction with this system and the surround channel is only used for sound effects when a overall sound is wanted such as an ambience effect, for example the sound of the ocean during a beach or marine scene, or motor noise in a vehicle. Such sounds are usually mixed so they come from all the loudspeakers, including the ones behind the screen. Specific effects which are intended to come from the surround channel only are rare. In current films the major signal in the surround channel is music, which is usually mixed so at least some of the sound comes from around the listener. Depending on the taste of a particular director or sound mixer, music may be relatively equally loud in all loudspeakers, or may have a bias toward the front—i.e., it is mixed so the surround speakers are at a somewhat lower level than the front loudspeakers.

This surround system has a number of disadvantages, especially when such a system is adapted to use in the home. One of the major disadvantages is that the main left and right loudspeakers are confined to the width of the screen. There has been considerable research into listener preference for music signals, which has shown that the optimal angle between the listener and the two main speakers should be plus and minus thirty degrees or more. Research into concert hall acoustics has also shown that it is desirable to have as much sound as possible travelling laterally—from left to right or right to left across the listener's head. Such lateral sound is provided in a general way by the standard surround array which extends to the sides of the listener, but due to the fact that both the left and right sides of the surround system are being driven by the same signal, and the usual rather low level of signals in the surround channel, this array does not produce adequate lateral energy from film music. The left and right main speakers, which carry the bulk of the music energy, subtend a narrow angle to the front of the typical listener. In the home, if the left and right speakers are placed close to the edges of a typical video screen, they are even closer together, and produce a very cramped musical image with little lateral sound energy. The most direct way of increasing the lateral sound energy during film or music playback is to spread the left and right speakers wider outside the screen. This works well for music, but sound effects and occasional panned dialog will then appear to come from a much wider area that the area occupied by the screen. Such differences between the width of the visual and audio fields is bothersome to some people.

In accordance with one aspect of the invention, there is provided a system for converting encoded stereo signals, on input channels A and B into six output signals, consisting of the normal left, center, right and surround signals and at least two supplemental output channels. These supplemental channels produce outputs nearly identical to the main left and right front channels when music is being played with the addition of a small time delay, but reject sound effects and panned dialog. The supplemental channels are used to drive speakers placed in the forward part of the side walls of a theater, or to the sides of a listener in the home. Even when music is mixed to be predominantly in the front, the supplemental channels have adequate level to make music sound wider and more spacious, while effects and dialog panned anywhere inside the screen stay where they belong.

Previous decoders, for example of the type disclosed in U.S. Pat. No. 4,862,502 (hereinafter the '502 patent), the disclosure of which is expressly incorporated herein by reference, detect the intended direction of a signal and then enhance the level of the signal in that direction. The supplemental channels of a system in accordance with the current invention tend to eliminate signals for which an intended direction can be established. If there is only one signal coming into the signal converting system for example a monaural sound effect in the absence of music, the outputs of the supplemental channels are zero regardless of where the sound mixer directs the signal. The supplemental channels are fully active whenever signals such as music are present which are intended to come from many directions. When both a directional signal and non directional music are present at the same time, the supplemental channels smoothly reduce the level of the directional signal without changing the apparent level of the music.

Tests of decoders built in accordance with this invention have shown that these new supplemental channels when played through loudspeakers located on the sides of a listener are useful not only for surround encoded films, but for normal stereo music.

This advantage appears to remain even if the front left and right signals are not decoded (equal to the A+B inputs) and the center and surround channels are eliminated.

In accordance with another aspect of the invention, there is provided a sound reproduction system for converting encoded stereo signals on input channels A and B into signals on left, supplemental left, right, and supplemental right output channels, respectively, that includes a left output channel for producing output signals intended to come from the left direction; a supplemental left output channel for producing output signals similar in level (intensity) to output signals of the left output channel and with reduced steered signal level for left direction signals; a right output channel for producing output signals intended to come from the right direction; and a supplemental right output channel for producing output signals similar in level (intensity) to output signals on the left output channel and with reduced steered signal level for right direction signals.

Preferably, the supplemental left output channel includes first combining means for combining said input signal on said A channel with a plurality of modified attenuated signals to produce said supplemental left output; and the supplemental right output channel includes second combining means for combining said input signal on said B channel with a plurality of modified attenuated signals to produce said supplemental right output; and each of the supplemental left and right output channels includes a delay for delaying signals on the supplemental channels relative to signals on the left and right output channels. The encoded stereo signals on the input channels A and B include directional (steered) components and non-directional (unsteered) components.

In particular embodiments, decoder logic detects the intended direction of a sound from information encoded in the two input channels, enhances the level of that sound in the output channels which are closest to the intended direction, and attenuates that sound in the other output channels. For example, if a sound is to appear to be half way between the center and the left loudspeakers in a standard four channel film decoder, the two channel input for such a signal would consist of the same signal in both channels, but with the left channel somewhat louder than the right. With a passive decoder, where the center channel is simply the left plus the right channel, and the surround channel is the left minus the right, this sound would come from all four loudspeakers, and would be only vaguely located. An active decoder would enhance the signal in the left and the center loudspeakers, while eliminating it from the right and the surround loudspeakers. There are several ways to do active decoding in common practice. Certain of these methods, and the one in the '502 patent, have an additional desirable property in that the level of music or unsteered material is preserved in all speakers, at the same time as signals which are intended by the film producer to be steered to a particular direction are reduced or removed.

It is useful to think of the two inputs to the decoder as consisting of the sum of two types of signals. One, typically dialog or effects, is at least 6 to 10 dB louder than the other type of signal, and is intended to come from only one particular direction. This signal is relatively easy to detect by finding the ratio of the left input level to the right input level, as well as the level ratio of the center to the surround channels (left plus right to left minus right). Signals where one or both of these ratios is significantly different from unity may be termed STEERED.

The second type of signal is intended to come approximately equally from all channels, and is characterized by having little or no correlation between the two input channels. That is, the ratio of the left level to the right level, as well as the ratio of the left plus right to the left minus right are both about unity. This second type of signal is typically music or an over-all environmental sound effect, and may be termed UNSTEERED.

A signal converting system in accordance with this invention includes an output which actively reduces all steered signals, while preserving the level of unsteered signals. For example, when a loud sound effect is mixed directly into the left input channel, along with uncorrelated music in both input channels, the sound effect will appear enhanced in the regular left output channel, but will be actively removed from the supplemental left output channel. In the supplemental output channel, music energy from the left input which is lost when the sound effect is attenuated is replaced with music energy from the right channel, thus preserving the apparent loudness of the music in the supplemental output.

This reduction of steered signals from the supplemental channels while preserving the apparent loudness of unsteered signals preferably occurs regardless of the encoded direction of the steered signal, so no steered signal will appear at the supplemental outputs. In a particular embodiment, this technique is used to derive two new (supplemental) channels, one which is equivalent to the delayed left input for unsteered signals, and one which is equivalent to the delayed right input. These channels are connected to loudspeakers located at the sides of the listeners, with the normal surround speakers mostly behind the listener. The regular left, center and right speakers are located in their standard positions near the screen. (In a particular embodiment, the surround channel is also divided inside the decoder into two decorrelated outputs, so that there are seven channels available from the decoder.) Music and environment effects appear wide and rich, surrounding the listener dramatically, while sound effects stay localized to the screen. The results are similar to the sound from a six or seven channel film system such as Imax or Todd AO, but can be used in the home with the great number of films available in two channel surround format. The decoder can also easily be installed in a theater.

In a preferred embodiment, the system includes a left output channel for producing output signals from the stereo signals on the input channels A and B with enhanced level of steered signals intended to come from the left direction and reduced level of steered signals intended to me from other directions; a supplemental left output channel for producing output signals similar in level (intensity) to output signals of the left output channel and with reduced steered signal level for left direction signals; a center output channel for producing signals with enhanced level of steered signal components in the stereo signals on the input channels A and B that are intended to come from the center direction and reduced level of steered signals intended to come from other directions; a right output channel for producing output signals from the stereo signals on the input channels A and B with enhanced levels of steered signals intended to come from the right direction and reduced level of steered signals intended to come from other directions; a supplemental right output channel for producing output signals similar in level (intensity) to output signals on the right output channel and with reduced steered signal level for right direction signals; and a surround output channel for producing output signals with enhanced levels of steered signal components intended to come from the surround direction and reduced level of steered signals intended to come from other directions.

In a particular embodiment, the input signals are fed into four logarithmic level detectors, one each for the left input level A, the right input level B, the left plus right input level, and the left minus right input level. From the output of these detectors, four control signals are derived. Each of these control signals has a value which varied smoothly from zero to one as the ratio of the input levels varies. As an example, the left control signal is zero unless the ratio of the left input level to the right input level is greater than one, and varies smoothly from zero to one as this ratio increases above one. The other signals are similar—each is zero unless the input signal associated with the control signal is larger than its opposite signal, and it rises smoothly to one as its input signal ratio rises.

In the embodiment described in the '502 patent, the control signals all have the same mathematical shape, and as can be seen from the above description, only two of the four signals are non-zero at any one time. To derive or understand their mathematical shape we need to consider only one set of directions, such as all directions between the left main loudspeaker and the center speaker. As the direction of a signal varies from left to center the left control signal varies from one to zero, and the center control signal varies from zero to one. As a convenience for mathematical description a direction pointer t can be derived which is an angle between left and center, where $t=\phi$ is equivalent to full left, and $t=45°$ is equivalent to full right. The input signals to the decoder can be the encoded such that:

$$\textit{left input } A=\cos(t)*sig$$

$$\textit{right input } B=\sin(t)*sig$$

where t is a direction pointer which varies from 0 degrees to 45 degrees (t=0 is equivalent to full left, t=45 is equivalent to center), and "sig" is the audio signal. For the purposes of analysis, the signal "sig" can be assumed to be a sine wave of constant unity amplitude. Since this sinusoidal signal will be common to all inputs and outputs only the direction determining elements cos(t) and sin(t) are retained in the following discussion.

The input signal has the property that the total energy in both channels is constant as the direction pointer t changes: $A^2+B^2=1$ and that when t=45 degrees $\sin(t)=\cos(t)=1/\sqrt{2}$. This is the standard film encoding.

The decoder detects the encoded direction t by finding the ratio of the input levels, such that:

$$t=\arctan(\textit{level } A/\textit{level } B)$$

t is defined for directions between left and center Both the decoder described in the '502 patent and this patent are symmetric in their design—and it is sufficient to consider their behavior in only one quadrant to derive the shape of the control signals in the other quadrants. In each quadrant the angle t will have a different but related meaning. As a pan from left to center is performed, the left control signal will start at one (full left) and decay to zero; the right control signal will always be zero, since the ratio of the right input to the left input is always less than one; the surround or left minus right control signal is also always zero; and the center or left plus right control signal will vary from zero to one. The left output of the decoder should vary from a maximum at t=0 to zero at t=45, while the center output varies from zero at t=0 to a maximum at t=45, and the right output and the surround output are zero. If A=cos(t) and B=sin(t) in the equations given below for the right output and the rear output of the decoder, and these two outputs are set to zero, the functional form for the left control signal and the center control signals can be derived. The left control signal is given by:

$$\textit{left control signal}=((\cos(t)-\sin(t))/\cos(t))=GL$$

for 45 degrees>t >0 ONLY

Similarly, the functional form of the center control signal is:

$$\textit{center control signal}=(\sin(t)/(\cos(t)+\sin(t))=GC$$

as t varies from 45 to 0

By symmetry these two shapes must be the same, but one is increasing while the other is decreasing.

The right (GR), center (GC), and rear (GS) control signals all have the same functional shape, and can be determined simply by knowing the ratio of the various input levels. For any input signal at least two of the control signals are always zero. In working with these formulas mathematically the results as a signal varies from quadrant to quadrant should be considered separately.

The four control signals derived in this way are used to control variable gain amplifiers, and the outputs of these amplifiers are combined to get the four outputs of the decoder. The outputs can be written as follows:

If the left input is given by A
the right input by B
the left control signal is GL
the right control signal is GR
the center control signal is GC
the rear control signal is GS
the various outputs are given by:

$$\textit{left output}=A+0.41*A*GL-0.5*(A+B)*GC-0.5*(A-B)*GS$$

$$\textit{right output}=A+0.41*B*GR-0.5*(A+B)*GC+0.5*(A-B)*GS$$

$$\textit{center output}=A+B+0.41*(A+B)*GC-A*GL-B*GR$$

$$\textit{rear output}=A-B+0.41*(A-B)*GS-A*GL+B*GR$$

If A=cos(t) and B=sin(t) are substituted into these formulae, the outputs have the desired properties. For example, if a signal varies from left to center (t varies from 45 degrees to 0) the right output and the rear outputs are always zero, and the left and center outputs are enhanced by 3 dB (1.41) as desired.

In accordance with the invention, two supplemental outputs are added—left supplemental and right supplemental. While there are a number of ways of constructing outputs with the desired properties, a simple and useful one is the following:

$$\textit{left supplemental}=A-A*GSL-0.5*(A+B)*GC-0.5*(A-B)*GS-B*GL$$

*right*
*supplemental*$=B-B*GSR-0.5*(A+B)*GC+0.5*(A-B)*GS-A*GR$

These outputs have some similar elements to the standard left and right outputs, but two supplemental terms are introduced in each output and there are two new control signals, GSL and GSR.

$$GSL=GL*((1-\sin(t))/\cos(t))$$

GSR is similarly related to GR, but with t defined to match the ratio of right level to left level.

If we assume as before:

$$A=\cos(t)*sig$$

$$B=\sin(t)*sig$$

we see that the new outputs have the desired properties—that is:

left supplemental = right supplemental = $\phi$ for all values of t from $\phi$ to 45°. Thus these new outputs reject signals steered between left, center, and right.

For unsteered signals, where $$GSL=GL=FR=GL=GS=GSR=\phi$$

the supplemental outputs are simply equal to the A and B inputs respectively.

In addition, if we assume:

$$A=\cos(t)*sig+delta1$$

$$B=\sin(t)*sig+delta2$$

where delta1 and delta2 are assumed to be not correlated with each other, at least 10 dB lower in level than sig, and approximately equal in level, it can be shown that the sum of delta1 squared and delta2 squared in the left side and right side outputs is approximately constant as t varies. This shows that music signals will be relatively little affected as steered signals are removed from these two outputs.

Although the two side outputs are zero for signals panned from left to center and from center to right, this is not true of signals panned from left to rear, or from right to rear. The decoder has been tested and the only discerned effect is to cause some leakage between the side outputs and the rear output.

The new decoder adds some complexity to the four channel decoder of the '502 patent as it involves four additional gain multiplies, and two new control signals. Only two of these four multiplies are active at a time, so the total number of active gain control devices at any time in the decoder is four, instead of two as in the '502 decoder. In a digital implementation the computational burden of the additional multiplies or the additional control signals is not large, since they can be easily derived from the signals already present through a suitable look-up table. Additional hardware is required for the additional output sums and the two new outputs.

Other features and advantages of the invention will be seen as the following description of a particular embodiment progresses, in conjunction with the drawings, in which.

Description of Particular Embodiment

Figure 1:
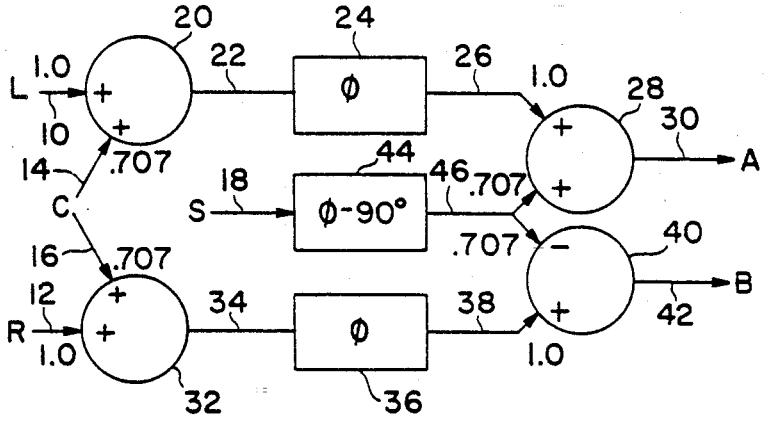
FIG. 1 is a simplified block diagram of an encoder of the Dolby type.

With reference to FIG. 1, a Dolby surround encoder includes L (left) input on line 10, R (right) input on line 12, C (center) inputs on lines 14, 16, and S (surround) input on line 18. The L input and a 0.707 C input are applied to summing circuit 20 and its output is applied on line 22 to phase compensation circuit 24 whose output is applied on line 26 to summing circuit 28 that produces A output on line 30. The R input on line 12 is similarly applied to summing circuit 32 and combined with a 0.707 C input for application on line 34 to phase compensation circuit 36 whose output on line 38 is applied to subtractor circuit 40 which has an output on line 42 as the B signal. The surround signal S on line 18 is applied to phase shift circuit 44 whose output on line 46 is supplied (×0.707) to summing circuit 28 and subtractor circuit 40 to provide output signals A and B on lines 30, 42, respectively.

Ignoring the phase shift common to all inputs, the encoder shown in FIG. 1 is characterized by the encoding equations:

$$A=L+0.707C-j0.707S; \text{ and}$$

$$B=R+0.707C+j0.707S,$$

where the j coefficient denotes an idealized frequency-independent 90° phase shift.

Figure 2:
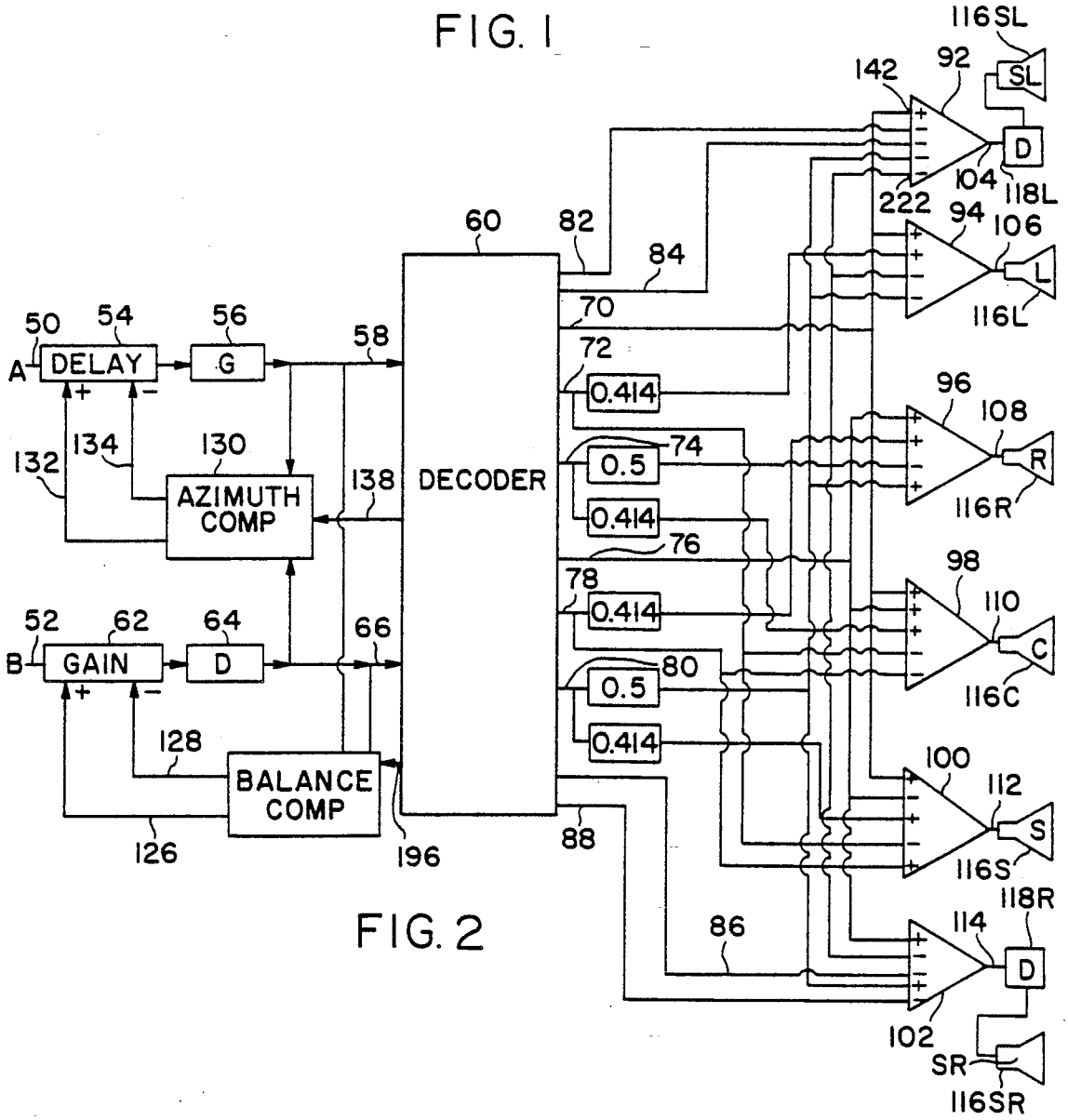
FIG. 2 is a simplified block diagram of a stereo decoder in accordance with the invention.

The A and B signals are applied to the decoder system shown in FIG. 2 on lines 50, 52, respectively. The A signal on line 50 is passed through variable delay circuit 54 and gain circuit 56 for application to input 58 of decoder 60. The B signal on line 52 is passed through variable delay circuit 62 and gain circuit 64 for application to input 66 of decoder 60.

Decoder 60 has an A output on line 70, an attenuated $A_a$ output on line 72, a B output on line 76, an attenuated $B_a$ output on line 78, an attenuated $C_a$ output on line 74, an attenuated $S_a$ output on line 80, an attenuated $A_c$ output on line 82, an attenuated $B_y$ output on line 84, an attenuated $A_x$ output on line 86, and an attenuated $B_d$ output on line 88. Those output signals are applied to a combining matrix that includes combining units 92, 94, 96, 98, 100 and 102, the output of combining unit 92 being applied over line 104 through fifteen millisecond delay 118B to one or more output devices such as loud speaker 116SL, the output of combining unit 94 being applied over line 106 to one or more output devices such as loud speaker 116L, the output of combining unit 96 being applied over line 108 to one or more output devices such as loud speaker 116R, the output of combining unit 98 being applied over line 110 to one or more output devices such as loud speaker 116C, the output of combining unit 100 being applied over line 112 to one or more output devices such as loud speaker 116S, and the output of combining unit 102 being applied over line 114 through fifteen millisecond delay 118R to one or more output devices such as loud speaker 116SR. The following table summarizes the inputs to the combining units 92–102:

| Combining Units | Inputs |
|---|---|
| 92 | $+A, -0.5C_a, -0.5S_a, -A_c, -B_y$ |
| 94 | $+A, +0.414A_a, -0.5C_a, -0.5S_a$ |
| 96 | $+B, +0.414B_a, -0.5C_a, +0.5S_a$ |
| 98 | $+A, +B, +0.414C_a, -A_a, -B_a$ |
| 100 | $+A, -B, +0.414S_a, +B_a, -A_a$ |
| 102 | $+B, -0.5C_a, +0.5S_a, -B_d, -A_x$ |

Connected between lines 58 and 66 are balance compensation 124 whose outputs 126, 128 are connected to variable gain circuit 62 and azimuth compensation 130 whose output are applied over lines 132, 134 to variable delay 54. Decoder 60 has a dialog sensing output on line 136 to balance compensation 104 and a similar dialog sensing output on line 138 to azimuth compensation 30.

Figure 3:
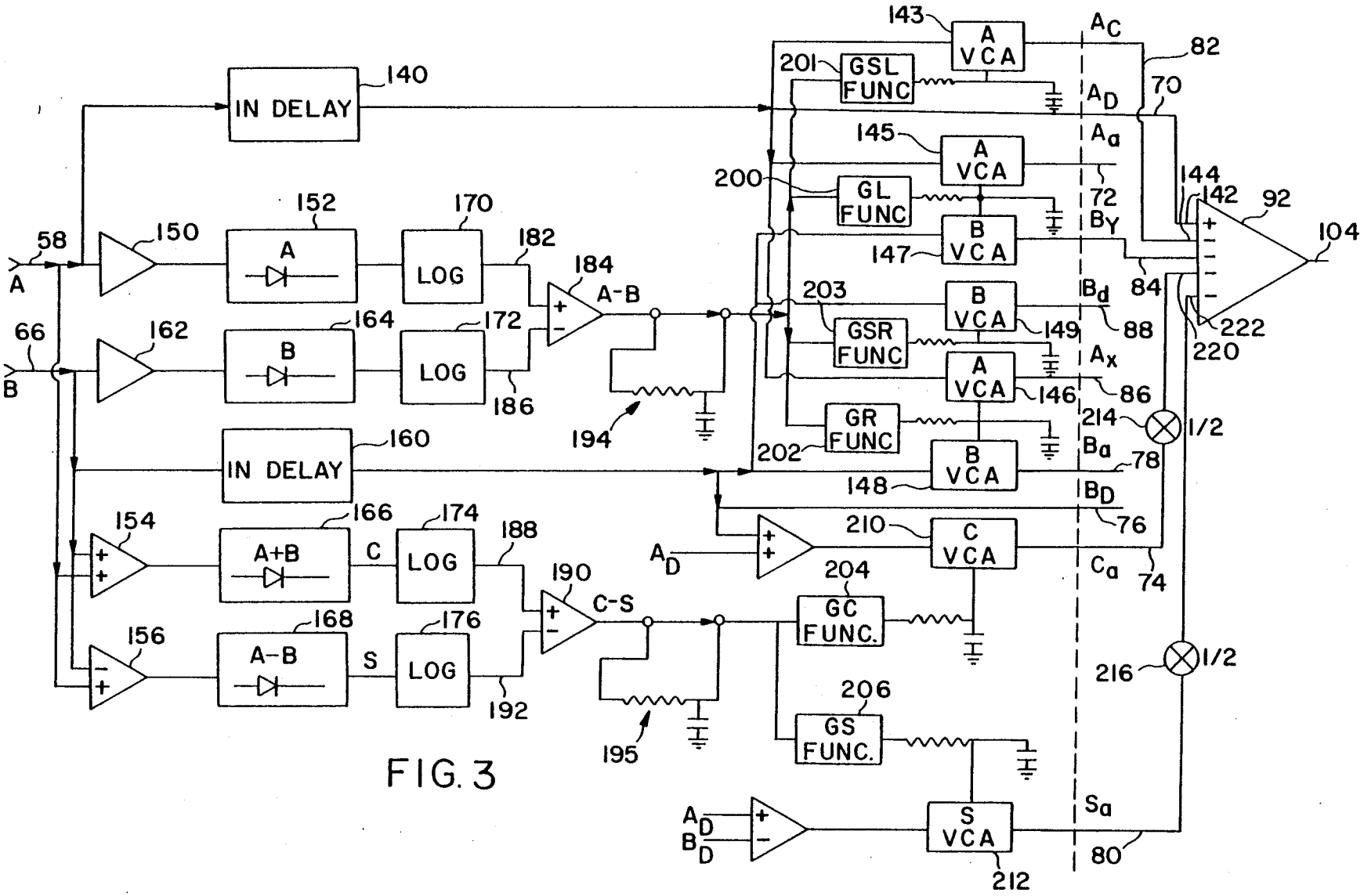
FIG. 3 is a block diagram of decoder logic employed in the decoder system of FIG. 2.

Further details of decoder 60 may be seen with reference to FIG. 3. The A input signal on line 58 is applied through sixteen millisecond delay 140 and over line 70 to plus input 142 of combining component 92 whose output is applied on line 104. The output of delay 140 is also applied to attenuator 143 (which may be a voltage controlled amplifier in an analog embodiment or a digital multiplier in a digital embodiment) and its output on line 82 is applied to minus input 144 of combining component 92. The output of delay 140 is also applied to attenuators 145 and 146. In addition, the signal on line 58 is applied through gain element 150 to rectifier 1452, to adder 154 and to the positive input of subtractor 156.

The B input signal on line 66 is similarly applied through sixteen millisecond delay 160 to output line 76, attenuators 147, 148 and 149, gain element 162, adder 154, and to the negative input of subtractor 156. Thus, adder 154 applies the sum of the signals on lines 58 and 66 as a C (center) output signal to rectifier 166 and subtractor 156 applies the difference of those two signals as an S (surround) output to rectifier 168.

Coupled to the output of each rectifier 152, 164, 166 and 168 is a log circuit 170, 172, 174, 176, respectively (which may be look-up tables in a digital embodiment)—the output of log circuit 170 on line 182 being the log of the value of the input signal A that is applied to the positive input of subtractor 184; the output of log circuit 172 on line 186 being the log of the input signal B which is applied to the negative input of subtractor 184; the output of log circuit 174 on line 188 being the log of the sum (C) of those two input signals which is applied to the positive input of subtractor 190; and the output of log circuit 176 on line 192 being the log of the difference (S) of those two input signals and applied to the negative input of subtractor 190. Connected to the output of each subtractor 184, 190 is a switched time constant arrangement 194, 195, respectively, for selectively inserting a delay, (for example one hundred millisecond). The output of subtractor 184 is applied to function circuits 200, 201, 202 and 203 (which may be look-up tables in a digital embodiment) while the output of subtractor 190 is applied to function circuits 204, 206.

The output of subtractor 184 (A0B) as modified by GL function circuit 200 is applied to attenuator 145 to modify the A input and providing a steering control ($A_a$) output on line 72 and to attenuator 147 to modify the B input and provide a steering control ($B_y$) output on line 84; as modified by GSL function circuit 201 is applied to attenuator 143 to modify the A input and provide steering control ($A_c$) output on line 82; as modified by GR function circuit 202 as applied to attenuator 146 to modify the A input and provide a steering control ($A_x$) output on line 86 and to attenuator 148 to modify the B input and provide a steering control ($B_a$) output on line 78; and as modified by GSR function circuit 203 as applied to attenuator 149 to modify the B input provided a steering control ($B_d$) output on line 88.

The log difference signal (C-S) from subtractor 190 is applied through time constant network 195 to function circuits 204 and 206 to modify respectively the C signal applied to attenuator 210 and the S signal applied to attenuator 212. The steering control signals $C_a$ and $S_a$ on lines 74 and 80 are applied through 0.5 amplification stages 314, 216 to inputs 220, 222, respectively, of combining unit 92. Function circuits 200, 201, 202, 203, 204 and 206 are preferably implemented such that smooth steering and complete cancellation in outputs are obtained while preserving the energy of both the steered and unsteered signals.

The system also includes automatic gain control (AGC) of the input signals in elements 15-, 154, 156 and 162. In an analog implementation, analog peak detectors and rectifiers may be used which continuously follow the input signals while in a digital implementation, level signals may be read periodically and adjusted appropriately.

While a particular embodiment of the invention has been shown and described, various modifications thereof will be apparent that the invention be limited to the disclosed embodiment, or to details thereof, and departures may be made therefrom within the spirit and scope of the invention.

What is claimed is:

1. A sound reproduction system for converting encoded stereo signals on input channels A and B into signals on left, supplemental left, center, right, supplemental right, and surround output channels, respectively, comprising:

a left output channel for producing output signals from said stereo signals on said input channels A and B with enhanced level of steered signal intended to come from the left direction and reduced level of steered signals intended to come from other directions;

a supplemental left output channel for producing output signals similar in level (intensity) to output signals of said left output channel and with reduced steered signal level for left direction signals;

a center output channel for producing signals with enhanced level of steered signal components in said stereo signals on said input channels A and B that are intended to come from the center direction and reduced level of steered signals intended to come from other directions;

a right output channel for producing output signals from said stereo signals on said input channels A and B with enhanced levels of steered signals intended to come from the right direction and reduced level of steered signals intended to come from other directions;

a supplemental right output channel for producing output signal similar in level (intensity) to output signal on said right output channel and with reduced steered signal level for right direction signals; and a surround output channel for producing output signals with enhanced levels of steered signal components intended to come from the surround direction and reduced level of steered signals intended to come from other directions.

2. The system of claim 1 wherein each of said left, right, center and surround channels includes means for detecting the intended signal direction and enhancing the level of the steered signals in that direction.

3. The system of claim 1 wherein said encoded stereo signals on said input channels A and B include directional (steered) components and non-directional (unsteered) components.

4. The system of claim 1 wherein said left output channel includes first combining means for combining said input signal on said A channel with a modified first attenuated signal, a modified third attenuated signal and a modified fourth attenuated signal to produce said left output;

said right output channel includes second combining means for combining said input signal on said B channel with a modified second attenuated signal, a modified third attenuated signal, and a modified fourth attenuated signal to produce said right output;

said center output channel includes third combining means for combining said input signals on said A and B channels with a modified third attenuated signal, said first attenuated signal and said second attenuated signal to produce said center output;

said surround output channel includes fourth combining means for combining said input signals on said A and B channels with a modified fourth attenuated signal, said first attenuated signal and said second attenuated signal to produce said surround output;

said supplemental left output channel includes fifth combining means for combining said input signal on said A channel with a modified first attenuated signal, a modified third attenuated signal, a modified fifth attenuated signal and a modified sixth attenuated signal to produce said supplemental left output; and said supplemental right output channel includes sixth combining means for combining said input signal on said B channel with a modified second attenuated signal, and modified fourth, fifth and sixth attenuated signals to produce said supplemental right output.

5. The system of claim 1 wherein each of said supplemental left and right output channels includes a delay for delaying signals on said supplemental channels relative to signals on said left, center, right and surround output channels.

6. A sound reproduction system for converting encoded stereo signals on input channels A and B into signals on left, supplemental left, right, and supplemental right output channels, respectively, comprising:

a left output channel for producing output signals intended to come from the left direction;

a supplemental left output channel for producing output signals similar in level (intensity) to output signals of said left output channel and with reduced steered signal level for left direction signals;

a right output channel for producing output signals intended to come from the right direction; and a supplemental right output channel for producing output signals similar in level (intensity) to output signals on said left output channel and with reduced steered signal level from right direction signals.

7. The system of claim 6 wherein said supplemental left output channel includes first combining means for combining said input signal on said A channel with a plurality of modified attenuated signals to produce said supplemental left output; and said supplemental right output channel includes second combining means for combining said input signal on said B channel with a plurality of modified attenuated signals to produce said supplemental right output.

8. The system of claim 6 wherein each of said supplemental left and right output channels includes a delay for delaying signals on said supplemental channels relative to signals on said left and right output channels.

9. The system of claim 8 wherein said encoded stereo signals on said input channels A and B include directional (steered) components and non-directional (unsteered) components.

10. The system of claim 8 and further including a center output channel for producing signals with enhanced level of steered signal components signals with signal on said input channels A and B that are intended to come from the center direction and reduced level of steered signals intended to come from other directions; and a surround output channel for producing output signals with enhanced levels of steered signal components intended to come from the surround direction and reduced level of steered signal intended to come from other directions.

11. The system of claim 10 wherein each of said supplemental left and right output channels includes a delay for delaying signals on said supplemental channels relative to signals on said left and right output channels.

12. A sound reproduction system for converting encoded stereo signals on input channels A and B into signals on left, supplemental left, center, right, supplemental right, and surround output channels, respectively, comprising:

means for attenuating the input signal on the A input channel as a function of the difference of the logs of the signals on the A and B input channels to produce first and second attenuated signals, means for attenuated the input signal on the B input channel as a function of the difference of the logs of the signals on the A and B input channels to produce third and fourth attenuated signals, means for attenuating the sum of the input signals on the A and B input channels as a function of the difference of the logs of the sum and difference of the signals on the A and B input channels to produce a fifth attenuated signal, means for attenuating the difference of the signals on the A and B input channels as a function of the difference of the logs of the sum and difference of the signals on the A and B input channels to produce a sixth attenuated signal, means for attenuating the input signal on the A input channel for actively reducing all steered signals, while preserving levels of unsteered signals to produce a seventh attenuated signal, means for attenuating the input signal on the B input channel for actively reducing all steered signals, while preserving levels of unsteered signals to produce an eighth attenuated signal, and means for combining the signal on the A input channel, the signal on the B input channel, the sum of the signals on the A and B input channels, the difference of the signals on the A and B input channels, and said first, second, third, fourth, fifth, sixth, seventh and eight attenuated signals to produce left, supplemental left, center, right, supplemental right and surround outputs.

13. The system of claim 12 wherein said combining means includes first combining means for combining said input signal on said A channel with modified first, third and fourth attenuated signals to produce said left output;

second combining means for combining said input signal on said B channel with modified second, third and fourth attenuated signal to produce said right output;

third combining means for combining said input signals on said A and B channels with modified first, second and third attenuated signals to produce said center output;

fourth combining means for combining said input signals on said A and B channels with modified first, second and fourth attenuated signals to produce said surround output;

fifth combining means for combining said input signal on said A channel with modified first, third, fifth and sixth attenuated signal to produce said supplemental left output; and sixth combining means for combining said input signal on said B channel with modified second, fourth, fifth and sixth attenuated signals to produce said supplemental right output.

14. The system of claim 13 wherein each of said supplemental left and right output channels includes a delay for delaying signals on said supplemental channels relative to signals on said left, center, right and surround output channels.

15. The system of claim 14 wherein said encoded stereo signals on said input channels A and B include directional (steered) components and non-directional (unsteered) components.

* * * * *